United States Patent [19]

Viets et al.

[11] 3,998,386

[45] Dec. 21, 1976

[54] OSCILLATING LIQUID NOZZLE

[75] Inventors: Hermann Viets; Delbert F. Balster, both of Montgomery County; Howard L. Toms, Clark County, all of Ohio

[73] Assignee: The United States of America as represented by the Secretary of the Air Force, Washington, D.C.

[22] Filed: Feb. 23, 1976

[21] Appl. No.: 660,574

[52] U.S. Cl. ..... 239/102; 239/464; 239/472; 137/813

[51] Int. Cl.[2] ..... B05B 1/08; B05B 1/34

[58] Field of Search ..... 239/101, 102, 4, 464, 239/472; 137/812–814, 808, 826, 829

[56] References Cited

UNITED STATES PATENTS

| | | | |
|---|---|---|---|
| 3,563,462 | 2/1971 | Bauer | 239/102 |
| 3,741,481 | 6/1973 | Bauer | 239/102 |
| 3,911,858 | 10/1975 | Goodwin | 239/102 X |

FOREIGN PATENTS OR APPLICATIONS

| | | | |
|---|---|---|---|
| 1,206,616 | 8/1959 | France | 239/101 |
| 330,886 | 4/1972 | U.S.S.R. | 239/102 |

*Primary Examiner*—Robert S. Ward, Jr.
*Attorney, Agent, or Firm*—Joseph E. Rusz; Richard J. Killoren

[57] ABSTRACT

An oscillating liquid nozzle, for use in producing foam for fires, having a fluidic oscillating device attached to the nozzle exit with a pair of inner wall members spaced from the nozzle exit to form control ports. Outer wall members connect to the nozzle body and have scoop members positioned at their forward end which extend into the flow forward of the inner wall members to return a portion of the flow to the control ports and cause oscillation of the liquid stream leaving the nozzle exit.

4 Claims, 8 Drawing Figures

OSCILLATING LIQUID NOZZLE

RIGHTS OF THE GOVERNMENT

The invention described herein may be manufactured and used by or for the Government of the United States for all governmental purposes without the payment of any royalty.

BACKGROUND OF THE INVENTION

This invention relates to an oscillating liquid nozzle such as may be used in the production of foam for aircraft fires.

Fluidic oscillators have been used for switching a gas flow to divert the gas stream. When the operating fluid is a liquid, the oscillators normally must operate in a liquid environment. The patents to Bauer, 3,563,462 and 3,741,481 relate to special design fluidic oscillators for use with liquid flow in shower heads.

BRIEF SUMMARY OF THE INVENTION

This invention relates to a liquid nozzle wherein a pair of wall members, to which the exit flow can attach, are positioned adjacent the nozzle exit. Scoop elements are positioned in the liquid flow path beyond the wall members to return a portion of the liquid flow to control ports adjacent the nozzle exit. In one embodiment, divider plate members are provided to increase the length of the feedback path. In another embodiment, the scoops are made adjustable to permit changing of the amount of flow scooped into the feedback path.

IN THE DRAWINGS

DETAILED DESCRIPTION OF THE INVENTION

Figure 1:
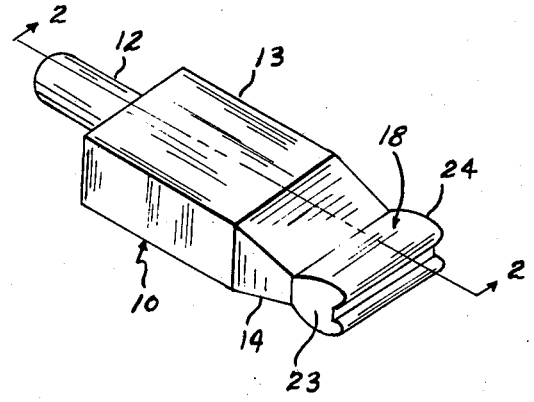
FIG. 1 is an isometric view of liquid nozzle according to this invention.
Figure 2:
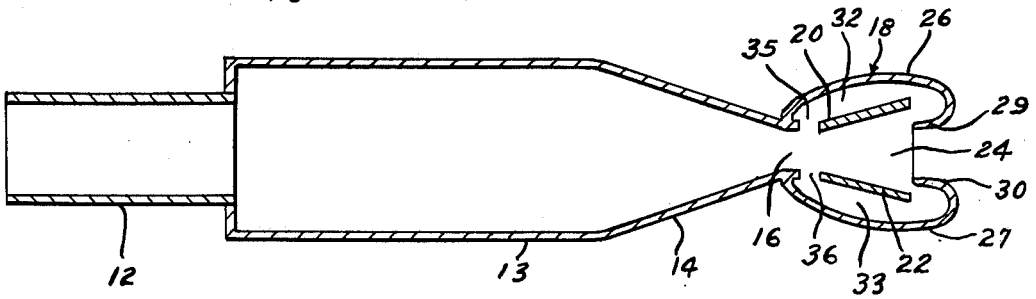
FIG. 2 is an enlarged sectional view of the device of FIG. 1 taken along the line 2—2.

Reference is now made to FIGS. 1 and 2 of the drawing, which show a liquid nozzle 10 having a nozzle body 13 with liquid supplied through inlet 12. The nozzle body has a converging portion 14 and an exit orifice 16. A fluidic oscillator 18 is positioned forward of the orifice 16. A pair of plate members 20 and 22 are positioned forward of the nozzle orifice and extend between walls 23 and 24. Outer wall members 26 and 27 extend from the nozzle wall adjacent the exit orifice 16 to a position forward of the plate members 20 and 22. Scoop members 29 and 30 are formed at the forward end of wall members 26 and 27 and extend inward of the walls 20 and 22 to intercept a portion of the liquid flow. The liquid flow intercepted by the scoops is directed through channels 32 and 33 to control ports 35 and 36 adjacent exit orifice 16. The scoops 29 and 30 must extend inward beyond walls 20 and 22 a distance great enough that both scoops contact the liquid stream at the position of maximum deflection of the streams in a direction away from the scoops to keep air from entering the channels 32 and 33.

Figure 3:
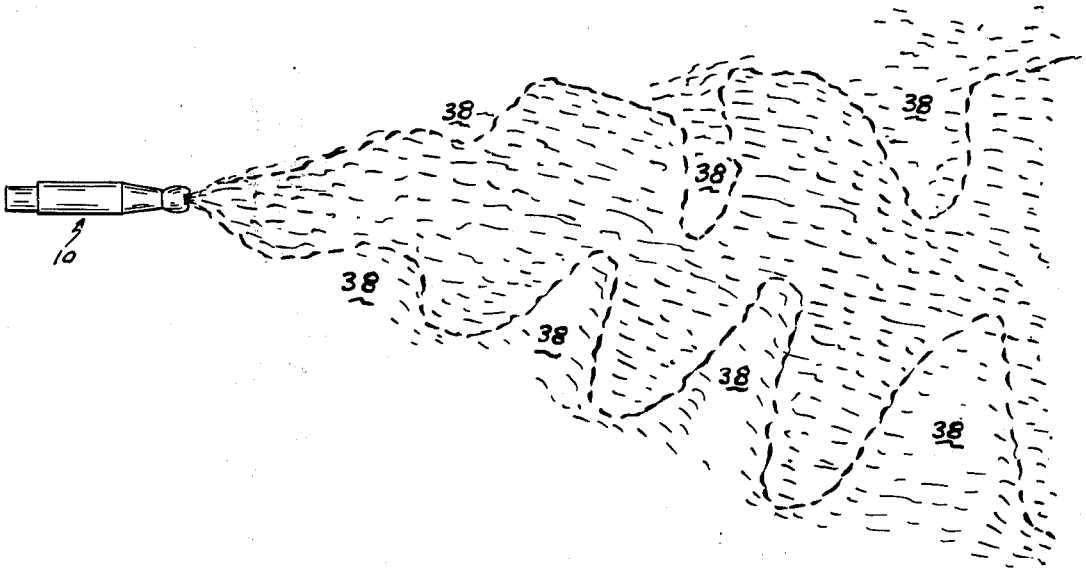
FIG. 3 shows a liquid flow pattern produced by the nozzle of FIGS. 1 and 2.

In the operation of the device of the invention, the liquid flow from orifice 16 will initially attach to one of the walls 20 or 22. The corresponding scoop 29 or 30 will intercept a greater portion of the flow stream than the other scoop. The differential flow in the channels 32 and 33 will act at the control ports 35 or 36 to switch the liquid stream to the other wall 20 or 22. This action continues to reverse the stream so as to provide an oscillating exit stream as illustrated in FIG. 3. The illustration shown in FIG. 3 is a graphical representation of a photograph of actual flow, as shown in one frame of a high speed motion picture. With a foaming agent added to the liquid flow, the gaseous pockets 38, in the flow, aid in producing foam for aircraft fires.

Figure 4:
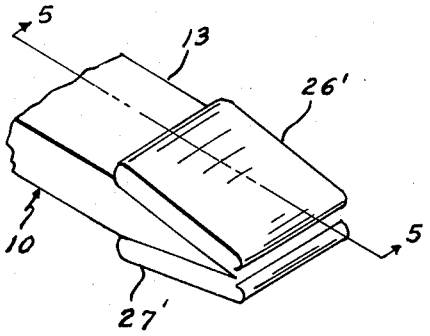
FIG. 4 shows a modification of the nozzle of FIG. 1.
Figure 5:
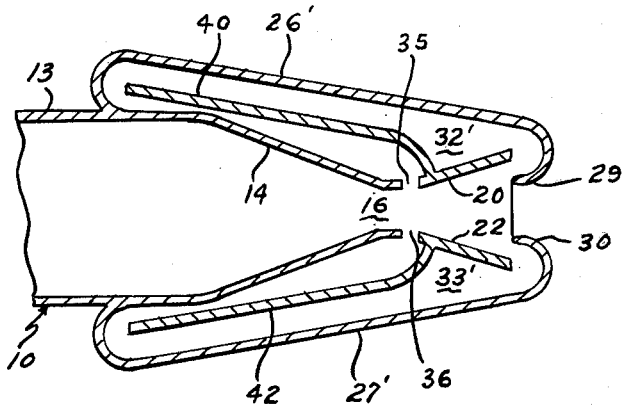
FIG. 5 is an enlarged sectional view of the device of FIG. 4 taken along the line 5—5.

Longer feedback paths between the scoops and the control ports can be provided as shown in FIGs. 4 and 5. In this device, the structure is substantially the same as in FIGs. 1 and 2, except that the outer wall 26′ and 27′ extend back of the convergent portion 14 of the nozzle body, and divider plates 40 and 42 are provided in the channels 32′ and 33′ to provide longer feedback path.

Figure 6:
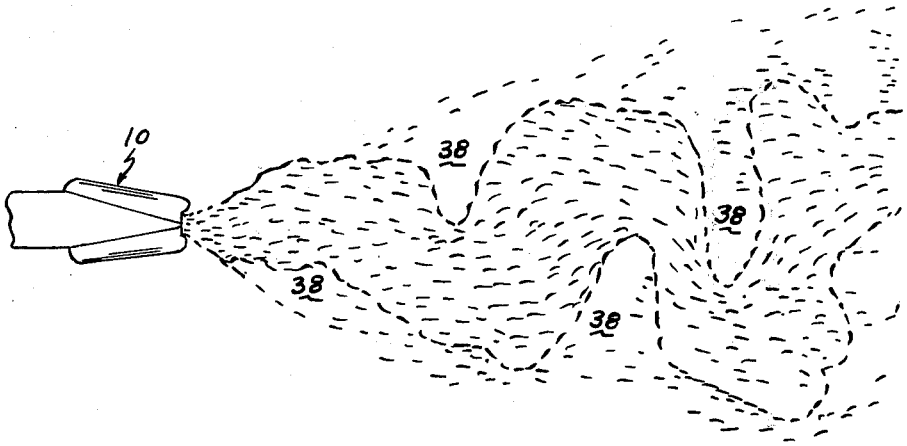
FIG. 6 shows a liquid flow pattern produced by the nozzles of FIGS. 4 and 5.

FIG. 6 is a graphical representation of the flow from the nozzle of FIGS. 4 and 5, which was made in the same manner as the illustration of FIG. 3.

Figure 7:
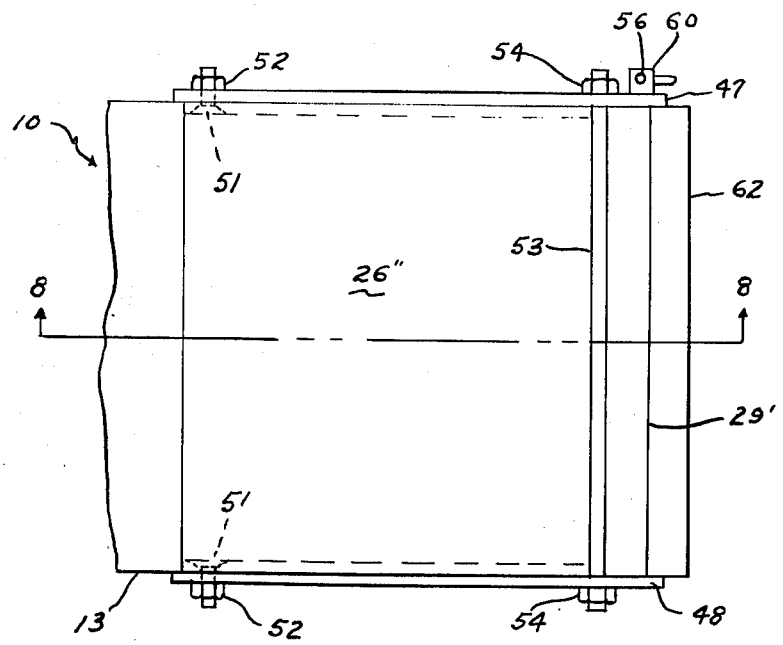
FIG. 7 is a partially schematic top plan view of a further modification of the device of the invention.
Figure 8:
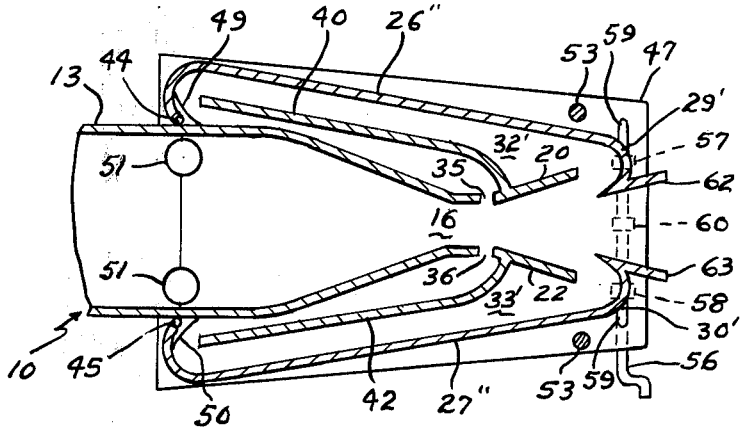
FIG. 8 is a sectional view of the device of FIG. 7 taken along the line 8—8.

A device which permits either regular flow or an oscillating stream is shown in FIGS. 7 and 8. In this device, the outer walls 26″ and 27″ are hinged at 44 and 45. Flexible seals 49 and 50 of a material such as rubber are cemented to walls 26″ and 27″ to nozzle body 13. Side walls 47 and 48 are secured to nozzle body by flat head bolts 51 and huts 52 and are held against the walls 26″ and 27″ by threaded rods 53 and nuts 54. The walls 26″ and 27″ are moved by means of a conventional double screw adjusting device 56 with left and right hand threads which move control blocks 57 and 58 in opposite directions. Blocks 57 and 58 are pivotably attached to scoop members 29′ and 30′ by pivot pins, not shown, which pass through slots 59. A centering block 60 is secured to wall 47. The double acting screw 56 may be held in block 60 by any conventional retaining means such as snap rings, not shown. Nuts 52 and 54 are loosened to permit adjustment of walls 26″ and 27″ and tightened again after adjustment. It was found that no seals were needed between walls 26″, 27″ and walls 47 and 48. However, seals may be provided if needed. It was found that the performance was improved in some flow regimes when lip members 62 and 63 were provided on scoop members 29′ and 30′.

The operation of this device is substantially the same as that described above. Movement of the scoops 29′ and 30′ out of the flow will permit normal operation of the nozzle, whereas the frequency of the oscillations can be increased and the amplitude decreased by moving the scoops a greater distance into the flow.

There is thus provided an oscillating liquid nozzle which may be used in the production of foam for aircraft fires.

We claim:

1. An oscillating liquid nozzle, comprising: a liquid flow channel having converging portion; an exit orifice adjacent the coverging portion of said flow channel, means for supplying a continuous flow of liquid through said flow channel; a fluidic oscillator connected to the output of said flow channel; said fluidic oscillator including a pair of inner wall members positioned adjacent the exit orifice on opposite sides of the exit orifice; said inner wall members being spaced from said exit orifice to form control ports; a pair of outer wall members secured to the liquid flow channel and extending forward of each of said inner wall members; a flow scoop on the forward end of each of said outer wall members, said flow scoops including means extending into the flow path beyond the inner wall members, for intercepting a portion of the liquid flow and directing it between the inner and outer walls to said control ports during all portions of the oscillating cycle.

2. The device as recited in claim 1 including means, secured to said inner wall members and positioned between said inner wall members and said outer wall members, for increasing the length of the flow path between said scoops and said control ports.

3. The device as recited in claim 1 wherein said ouer wall members are pivotably connected to said liquid flow channels, means, connected to said scoops for selectively moving said scoops relative to the flow path of the liquid from the exit orifice of the nozzle flow channel.

4. The device as recited in claim 3 including a lip member connected to each of said scoops.

* * * * *